US008424701B2

(12) United States Patent
Sambrailo et al.

(10) Patent No.: US 8,424,701 B2
(45) Date of Patent: Apr. 23, 2013

(54) COOLING METHOD AND NINE-DOWN PACKAGING CONFIGURATION FOR ENHANCED COOLING OF PRODUCE

(75) Inventors: Mark Sambrailo, Watsonville, CA (US); William K. Sambrailo, Aptos, CA (US); Mark Sambrailo, legal representative, Watsonville, CA (US); Anthony M. Cadiente, Salinas, CA (US)

(73) Assignee: Sambrailo Packaging, Inc., Watsonville, CA (US)

( * ) Notice: Subject to any disclaimer, the term of this patent is extended or adjusted under 35 U.S.C. 154(b) by 0 days.

(21) Appl. No.: 13/300,197

(22) Filed: Nov. 18, 2011

(65) Prior Publication Data

US 2012/0061391 A1 Mar. 15, 2012

Related U.S. Application Data

(60) Division of application No. 11/474,096, filed on Jun. 22, 2006, now Pat. No. 8,083,085, which is a continuation-in-part of application No. 10/017,893, filed on Dec. 12, 2001, now Pat. No. 7,100,788, which is a continuation-in-part of application No. 09/590,631, filed on Jun. 8, 2000, now abandoned, which is a continuation of application No. 09/060,453, filed on Apr. 14, 1998, now Pat. No. 6,074,676, which is a continuation-in-part of application No. 08/591,000, filed on Jan. 24, 1996, now Pat. No. 5,738, 890.

(60) Provisional application No. 60/791,678, filed on Apr. 12, 2006.

(51) Int. Cl.
*A47G 19/00* (2006.01)
*B65D 21/02* (2006.01)

(52) U.S. Cl.
USPC ..... 220/23.86; 220/23.88; 426/106

(58) Field of Classification Search ..... 220/4.21, 220/4.23, 23.86, 23.88; 426/106, 392; 229/120
See application file for complete search history.

(56) References Cited

U.S. PATENT DOCUMENTS 1,800,346 A 4/1931 Slagel
1,953,765 A 4/1934 McCluney
(Continued)

FOREIGN PATENT DOCUMENTS

CA 2340852 9/2001
CL 1452-98 6/1998
(Continued)

OTHER PUBLICATIONS

International Search Report, dated Mar. 12, 2003.
(Continued)

*Primary Examiner* — Harry Grosso
(74) *Attorney, Agent, or Firm* — Beyer Law Group LLP

(57) ABSTRACT

The invention encompasses packaging and cooling methods and systems designed to improve cooling efficiencies, reduce damage to the contents of containers, and increase product packing density. A system of the present invention incorporates baskets loaded into trays and trays loaded in preferred configurations on a pallet. The trays are loaded with baskets arranged in the tray so that ventilation slots and/or channels of the baskets are aligned with tray ventilation openings. Nine (9) trays are loaded onto a standard pallet in a 3 by 3 configuration. Additionally, the trays are arranged so that the tray ventilation openings are in alignment with ventilation openings of other trays of the same layer. This 3 by 3 layer of trays comprises a so-called "nine-down" configuration. As will be discussed below, his configuration has some surprising cooling advantageous standard packaging configurations.

9 Claims, 7 Drawing Sheets

U.S. PATENT DOCUMENTS

| | | | | |
|---|---|---|---|---|
| 2,652,335 | A | 9/1953 | Conti | |
| 2,660,529 | A | 11/1953 | Bloom | |
| 2,684,907 | A | 7/1954 | Brunsing | |
| 2,739,734 | A | 3/1956 | Pugh | |
| 2,936,094 | A | 5/1960 | Smith | |
| 3,037,658 | A | 6/1962 | Schray et al. | |
| 3,042,247 | A | 7/1962 | Bonnet | |
| 3,253,762 | A | 5/1966 | Gaunt | |
| 3,613,938 | A | 10/1971 | Westcott | |
| 3,651,977 | A | 3/1972 | Morgan | |
| 3,741,815 | A | 6/1973 | Peterson | |
| 3,794,090 | A | 2/1974 | Commisso | |
| 3,825,130 | A * | 7/1974 | Lapham | 414/281 |
| 3,912,118 | A | 10/1975 | Bird | |
| 3,937,389 | A | 2/1976 | Wind | |
| 4,206,845 | A | 6/1980 | Christian | |
| D256,097 | S | 7/1980 | Amberg | |
| 4,390,113 | A | 6/1983 | Bird | |
| 4,478,344 | A | 10/1984 | Rehrig | |
| D276,216 | S | 11/1984 | Michaud | |
| 4,529,088 | A | 7/1985 | Quong | |
| 4,570,818 | A | 2/1986 | Borst et al. | |
| 4,597,503 | A | 7/1986 | Lates | |
| 4,618,069 | A | 10/1986 | Quong | |
| 4,664,281 | A | 5/1987 | Falk et al. | |
| 4,704,510 | A | 11/1987 | Matsui | |
| 4,741,452 | A | 5/1988 | Holzkopf | |
| 4,767,008 | A | 8/1988 | Warnecke et al. | |
| 4,771,934 | A | 9/1988 | Kalmanides | |
| 4,819,822 | A | 4/1989 | Box | |
| 4,844,263 | A | 7/1989 | Hadtke | |
| 4,859,822 | A | 8/1989 | Ragusa et al. | |
| 4,883,195 | A | 11/1989 | Ott et al. | |
| 4,974,738 | A | 12/1990 | Kidd et al. | |
| D315,100 | S | 3/1991 | Sheehan | |
| 5,069,344 | A | 12/1991 | Dehart | |
| 5,076,459 | A | 12/1991 | DeHart | |
| 5,191,994 | A | 3/1993 | Stauble | |
| D339,744 | S | 9/1993 | Seppala | |
| 5,265,749 | A | 11/1993 | Zutler | |
| D343,576 | S | 1/1994 | Krupa | |
| D345,894 | S | 4/1994 | Krupa | |
| 5,312,034 | A * | 5/1994 | Nakagawa et al. | 229/120 |
| D348,608 | S | 7/1994 | Wyslotsky | |
| 5,339,973 | A | 8/1994 | Edwards et al. | |
| D354,436 | S | 1/1995 | Krupa | |
| 5,423,453 | A | 6/1995 | Fritz | |
| 5,429,296 | A * | 7/1995 | Southwell et al. | 229/168 |
| D361,035 | S | 8/1995 | Krupa | |
| D361,036 | S | 8/1995 | Krupa | |
| D363,022 | S | 10/1995 | Krupa et al. | |
| 5,456,379 | A | 10/1995 | Krupa et al. | |
| D363,879 | S | 11/1995 | Krupa et al. | |
| 5,465,901 | A | 11/1995 | Paine, Jr. | |
| 5,515,993 | A | 5/1996 | McManus | |
| D376,314 | S | 12/1996 | Krupa | |
| D378,192 | S | 2/1997 | Krupa et al. | |
| D379,300 | S | 5/1997 | Krupa et al. | |
| D380,381 | S | 7/1997 | Krupa et al. | |
| D382,795 | S | 8/1997 | Abayhan et al. | |
| D385,784 | S | 11/1997 | Krupa et al. | |
| 5,686,127 | A | 11/1997 | Stockley, III et al. | |
| D393,204 | S | 4/1998 | Goins et al. | |
| 5,738,890 | A | 4/1998 | Cadiente et al. | |
| 5,803,303 | A | 9/1998 | Timm et al. | |
| 5,833,116 | A | 11/1998 | Guillin | |
| 5,855,277 | A | 1/1999 | Apps et al. | |
| D409,485 | S | 5/1999 | Christy, Jr. | |
| 5,947,321 | A | 9/1999 | Vadney | |
| 6,007,854 | A | 12/1999 | Cadiente et al. | |
| 6,074,676 | A | 6/2000 | Cadiente et al. | |
| 6,257,401 | B1 | 7/2001 | Mangla et al. | |
| D448,288 | S | 9/2001 | Zettle et al. | |
| 6,644,494 | B2 | 11/2003 | Hayes et al. | |
| 6,962,263 | B2 | 11/2005 | Cadiente et al. | |
| 7,413,094 | B2 * | 8/2008 | Cadiente et al. | 220/23.88 |
| 7,703,628 | B2 | 4/2010 | Cadiente et al. | |
| 7,832,585 | B2 * | 11/2010 | Sambrailo | 220/23.86 |
| 2003/0077363 | A1 | 4/2003 | Cadiente | |
| 2003/0198714 | A1 | 10/2003 | Cadiente et al. | |
| 2007/0056980 | A1 | 3/2007 | Sambrailo | |

FOREIGN PATENT DOCUMENTS

| | | | |
|---|---|---|---|
| CL | 2205-03 | | 10/2003 |
| CL | 1745-06 | | 7/2006 |
| DE | 857860 | | 12/1952 |
| EP | 0765819 | | 4/1997 |
| GB | 1074164 | | 6/1967 |
| GB | 2160510 | A * | 12/1985 |
| GB | 2160510 | A | 12/1985 |
| GB | 2200340 | A | 8/1988 |
| MX | PA04002335 | | 9/2005 |
| WO | 00/20286 | | 4/2000 |

OTHER PUBLICATIONS

International Search Report, dated Apr. 20, 2004.

International Search Report, dated Jun. 23, 2005.

U.S. Appl. No. 11/207,258, filed Aug. 18, 2005, published Feb. 19, 2006.

Office Action in corresponding Chilean Application No. 1047-07, mailed Jul. 29, 2009.

Office Action dated Dec. 20, 2010 from Mexican National Phase PCT Patent Application No. 07/09806.

Office Action dated Dec. 10, 2010 from U.S. Appl. No. 12/718,869.

Office Action dated Dec. 9, 2010 from Peruvian Application No. 000799-2007.

Office Action dated Jan. 14, 2011 from Chilean Application No. 2205-03.

Notice of Allowance dated Mar. 14, 2011 from U.S. Appl. No. 12/718,869.

U.S. Appl. No. 13/158,209, filed Jun. 10, 2011.

* cited by examiner

COOLING METHOD AND NINE-DOWN PACKAGING CONFIGURATION FOR ENHANCED COOLING OF PRODUCE

CROSS-REFERENCE TO RELATED APPLICATIONS

This application is a divisional of U.S. application Ser. No. 11/474,096 filed Jun. 22, 2006, which takes priority under 35 U.S.C. 119(e) to U.S. Provisional Patent Application No. 60/791,678 filed Apr. 12, 2006. U.S. application Ser. No. 11/474,096 is a continuation-in-part of U.S. application Ser. No. 10/017,893, filed Dec. 12, 2001, now U.S. Pat. No. 7,100, 788, issued Sep. 5, 2006, which is a continuation-in-part of U.S. application Ser. No. 09/590,631, filed Jun. 8, 2000, which is a continuation of U.S. application Ser. No. 09/060, 453 filed Apr. 14, 1998, now U.S. Pat. No. 6,074,676, issued Jun. 13, 2000, which is a continuation-in-part of U.S. application Ser. No. 08/591,000, filed Jan. 24, 1996, now U.S. Pat. No. 5,738,890, issued Apr. 14, 1998, all of which are incorporated herein by reference for all purposes.

TECHNICAL FIELD

The present invention relates to an improved method and produce packaging configuration enabling the improved packing, cooling, storage, and shipping of produce. More particularly, the present invention improves a flow of cooling air through a container system (comprising vented produce containers aligned in vented holding trays) to substantially improve the rate of cooling in produce contained therein.

BACKGROUND

Many produce products are harvested and packed in the field into containers which are ultimately purchased by the end consumer. Examples of such produce items include, but are not limited to, tomatoes, berries, grapes, mushrooms, radishes and broccoli florets. Many of these produce items require substantial post-harvest cooling in order to enable shipping over long distances and to prolong shelf life.

In use, a grower's harvesting crew harvests produce items of the type previously discussed directly from the plant in the field into the container. The containers are then loaded into trays, which contain a specific number of individual containers and the trays, when filled, are loaded onto pallets. The most common pallet used in the produce industry in the United States is the forty by forty-eight inch (40"×48") wooden pallet, and the vast majority of produce handling, storage and shipping equipment is designed around pallets of this size.

After the pallets have been filled and loaded in the field, they are transported to shippers who perform a variety of post-harvest processes to enhance the marketability of the produce itself. For many types of produce, including berries, a significant packing evolution is the post-harvest cooling of the packed fruit. Indeed, berry shippers are often referred to as "coolers". The process of cooling berries typically includes injecting a stream of cooling air into one side of a tray and thence through the individual baskets and around the berries stored therein. As the air cools the berries, it picks up heat therefrom which is exhausted from apertures on the opposite side of the tray.

One commonly used packaging configuration is referred to in the industry as the so-called "five-down" packaging configuration. It is referred to a five down package because at each layer of a pallet five "trays" are stacked. Each of the "trays" is loaded with produce containers filled with produce. In some approaches each of the trays has many vents all over each side of the tray or no vents at all. In such cases the prior art has not paid much attention to vent placement. The point of this prior philosophy being that more vents is better. Alternatively, in many systems no tray vents at all are used.

Importantly, none of the prior art technologies paid any attention to the cooling efficiencies of the various configurations. In particular, no attention was paid to integrating the tray vents with vents in the produce containers (in those cases where the produce containers actually had vents). No attention was given to the idea of specifically sized and shaped containers or to placed in the containers and trays in a specific alignment to maximize produce cooling or to maximize pallet content.

In another prior art example, a "six-down" pallet loading configuration is used. Specifically, using current basket technology, a pallet loading configuration under the six-down system comprises six (6) trays per layer on the pallet. In one implementation eight (8) one pound baskets are loaded per tray, this means that forty eight pounds of fruit can be packed per layer on a standard 40 inch by 48 inch pallet. As currently employed, the current six down configuration suffers from sub-optimal tray and container packing. Neither the trays nor the containers shipped therein are fitted together properly. Thus, the package does not fully utilize the surface area of a forty by forty eight inch pallet. Therefore, current use packages and trays under-utilize the pallet. This of course forms a further inefficiency of shipping. This leads to higher costs. This same problem is found to exist across all size ranges for produces shipping trays and containers.

What is needed is a packaging method and cooling configuration that can fully take advantage of the packing space available on a standard 40"×48" pallet and provide improved cooling performance over the prior art. Moreover, there is a need for an improved berry packing system which will significantly reduce the cooling time and cooling expense for the fruit contained in the baskets. To make such an improved system feasible, it must interface with commonly used and preferred facilities and apparatus (e.g., the previously discussed forty by forty eight inch pallets in current use in the grocery industry).

Accordingly, what is needed is a packaging configuration and approach that provides maximum cooling performance and packing density.

SUMMARY OF THE INVENTION

In accordance with the principles of the present invention, an improved system and method for packaging, transporting, storing, and cooling produce are disclosed.

In general, the present invention is directed toward methods and produce packaging configurations that increase cooling rates for harvested produce and increase per pallet produce volume.

One embodiment of the invention comprises a method for produce cooling involving arranging a plurality of produce packaging containers in cooling trays so that ventilation slots of the packaging containers are in alignment with ventilation openings of the cooling trays. The containers are further arranged so that ventilation slots of the packaging containers are also in alignment with ventilation slots of other packaging containers. This arrangement enables airflow to pass into the tray and through each of the containers and back out through a ventilation opening at an opposite end of the tray. The trays are further arranged on a pallet in a three by three layer of trays placed so that ventilation openings of the cooling trays are directly adjacent to and in alignment with ventilation openings of at least one other cooling tray. Air flow is passed into the ventilation openings of the trays on a first side of the pallet and through each of the containers and trays and out of the ventilation openings of the trays on a second side of the pallet opposite the first side.

In another system embodiment the invention a plurality of produce packaging containers is arranged in a plurality of cooling trays so that ventilation slots of the packaging containers are in alignment with ventilation openings of the cooling trays. The ventilation slots of the packaging containers are further in alignment with ventilation slots of other packaging containers. Said arrangement enabling airflow to pass through the ventilation openings and through each of the containers and out of the cooling tray through a ventilation opening at an opposite end of the tray. The trays arranged on a pallet in a three by three layer of trays placed so that ventilation openings of the cooling trays are directly adjacent to and in alignment with ventilation openings of other cooling trays.

Other aspects and advantages of the invention will become apparent from the following detailed description and accompanying drawings which illustrate, by way of example, the principles of the invention.

BRIEF DESCRIPTION OF THE DRAWINGS

The following detailed description will be more readily understood in conjunction with the accompanying drawings, in which.

It is to be understood that in the drawings like reference numerals designate like structural elements. Also, it is understood that the depictions in the Figures are not necessarily to scale.

DETAILED DESCRIPTION OF THE INVENTION

The present invention has been particularly shown and described with respect to certain embodiments and specific features thereof. The embodiments set forth hereinbelow are to be taken as illustrative rather than limiting. It should be readily apparent to those of ordinary skill in the art that various changes and modifications in form and detail may be made without departing from the spirit and scope of the invention.

Generally, the principles of the invention encompass packaging and cooling methods and systems designed to improve cooling efficiencies, reduce damage to the contents of containers, and increase product packing density. A system of the present invention incorporates baskets loaded into trays and trays loaded in preferred configurations on a pallet. The trays are loaded with baskets arranged in the tray so that ventilation slots and/or channels of the baskets are aligned with tray ventilation openings. Nine (9) trays are loaded onto a standard pallet in a 3 by 3 configuration. Additionally, the trays are arranged so that the tray ventilation openings are in alignment with ventilation openings of other trays of the same layer. This 3 by 3 layer of trays comprises a so-called "nine-down" configuration. As will be discussed below, his configuration has some surprising cooling advantageous standard packaging configurations.

Figure 1A:
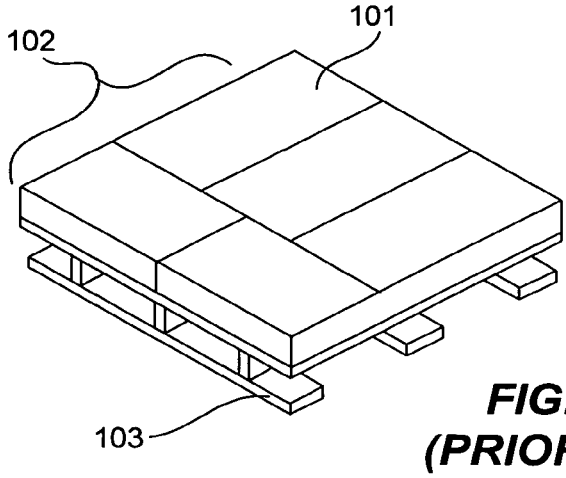
FIG. 1A (PRIOR ART)
FIGS. 1A and 1B are simplified perspective views of conventional tray packing layers used to package produce on a pallet.
Figure 1B:
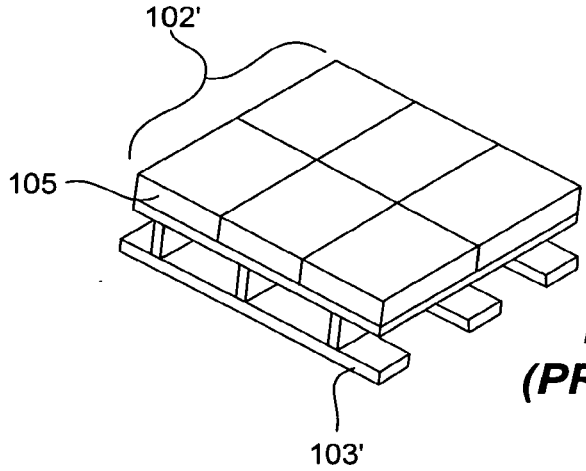
FIG. 1B (PRIOR ART)

FIGS. 1A and 1B depict prior art pallet layer configurations use various conventional packaging schemes. FIG. 1A depicts a so-called "five-down" packaging configuration having five trays 101 sized and arranged to fit on a layer 102 of a standard 40"×48" pallet 103. FIG. 1B depicts a so-called "six-down" packaging configuration having six trays 101' sized and arranged to fit on a layer 102' of the same size pallet 103. These trays are commonly filled with produce containers with successive layers of trays stacked over one another.

Figure 1C:
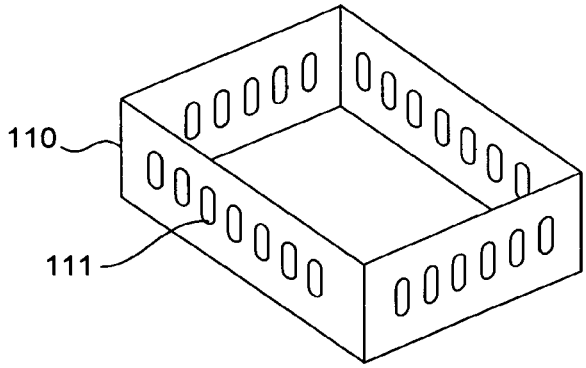
FIG. 1C is a perspective view of a non-invention produce packaging tray.

FIG. 1C depicts an example of a vented tray 110. The vented tray includes a number of vents 111 arranged about its outer walls to permit airflow into the tray. Importantly, these vents are arranged with no particular attention paid to the type of packaging container. This configuration is of a "one size fits all" configuration. No consideration is given to the unique advantages inherent in embodiments of the invention where tray container vent alignment is crucial.

Figure 2A:
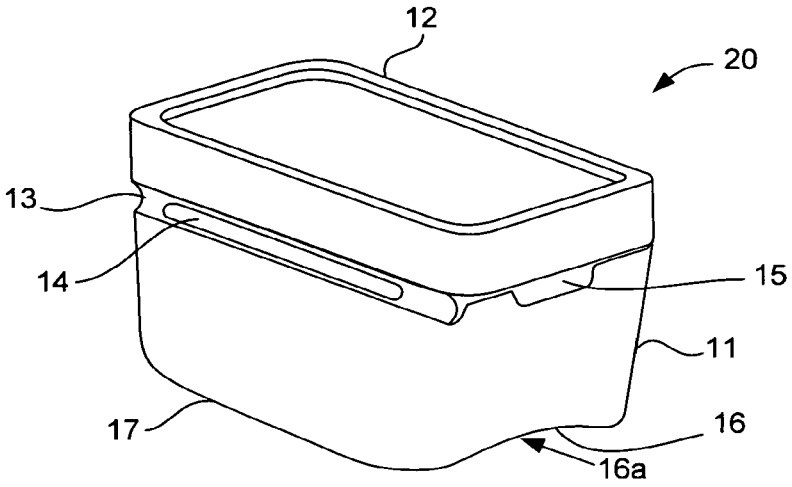
FIGS. 2A & 2B are simplified perspective views illustrating concepts present in certain produce packaging container embodiments discussed in the disclosure in accordance with the principles of the invention.

FIG. 2A schematically depicts one embodiment of a produce basket 20 of the present invention is shown. Produce basket 20 embodiment is a one-piece structure incorporating both basket body 11 and lid 12. In this embodiment, a hinge 13 joins basket body 11 and lid 12. It is to be noted that embodiments of the invention include baskets in a two-piece format that have a lid and body without a hinge. And also include baskets having two hinged lids that are closed together to seal the basket. In the depicted embodiment, the hinge is bent and the lid closed and generally secured with a latch or other securing mechanism. This keeps the contents secured inside during shipping and also during display in retail or other environments.

Importantly, the closed lid 12 now defines a ventilation slot 15 between the lid 12 and basket body 11 enabling a cooling airflow to enter the container 20. The airflow exits through a matching ventilation slot (no shown in this view) at the opposite of the container 20. These features are well described in previously issued U.S. Pat. Nos. 5,738,890; 6,007,854; 6,074,676; and 6,962,263 which are hereby incorporated by reference for all purposes. The point being that variously shaped and sized ventilation slots are positioned at either end of the container to enhance cooling flow. The applicants believe that elongate horizontal slots 15 provide the best cooling results. In order to further enhance cooling the depicted embodiment includes an arched bottom 16 that defines a ventilation channel 16*a* under the container 20. Additionally, more than one channel can be formed under a side of the container. Moreover, arched bottoms can be formed in an adjacent wall 17 of the container to facilitate ventilating cross flow. Such issues are addressed in greater detail in U.S. Pat. No. 6,962,263 which was previously incorporated by reference for all purposes.

Also, the depicted embodiment is shown with a ventilation slot 14 that passes through the hinge 13. This vent slot 14 enables directional ventilation flow through the top portion of the container. In some embodiments, the hinge vent slot 14 is positioned across from another ventilation slot on the opposite side of the container (not shown). This flow is transverse to the flow enabled by slot 15. In a related embodiment, vent slot 14 can comprise several vents through the hinge which still accomplishing the purposes of the invention. Alternatively, the slot ventilation need not be used at all.

Figure 2B:
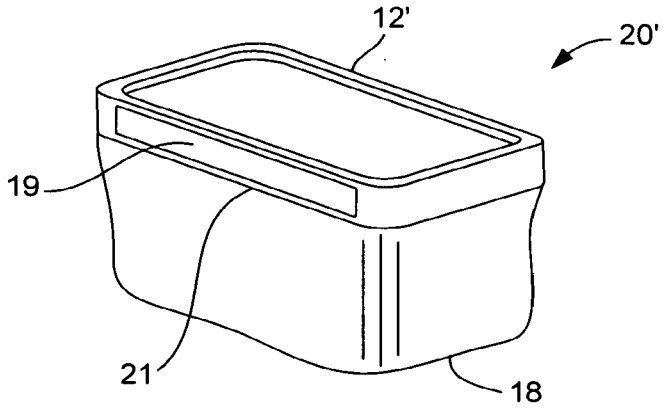

FIG. 2B schematically depicts another container 20' addressing certain other features. Produce container 20' embodiment is also a one-piece container incorporating a basket body and lid joined by a flexible hinge 21 and can include latches to secure the lid. In the depicted container 20' a ventilation slot 19 passes through the lid 12' rather than the hinge as in the previously discussed container 20. However, this vent slot 19 enables directional ventilation flow through the top portion of the container. In some embodiments, the hinge vent slot 19 is positioned across from another ventilation slot on the opposite side of the container (not shown). Such embodiment can further include many different varieties of side ventilation slots including, but not limited to, slots 15, as are depicted in FIG. 2A. Such embodiment can further include many different varieties of side ventilation slots including, but not limited to, slots 15 as are depicted in FIG. 2A. Additionally, containers of the invention can feature flat bottoms 8 rather than the previously depicted arched bottoms.

Figure 3A:
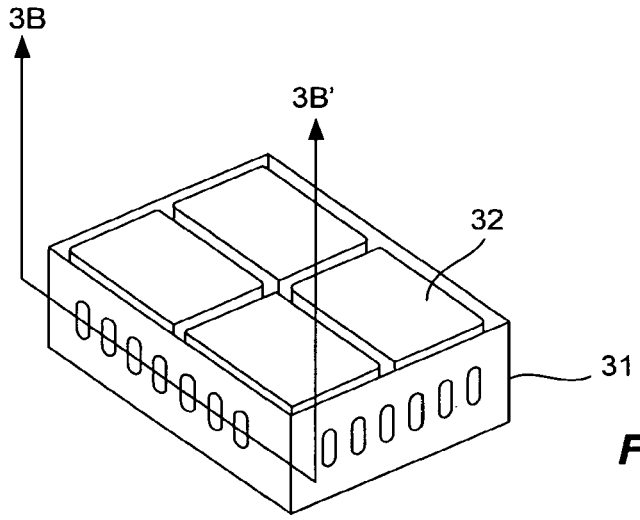
FIGS. 3A & 3B are simplified perspective and top down views (respectively) illustrating air flow problems inherent in some packaging schemes.
Figure 3B:
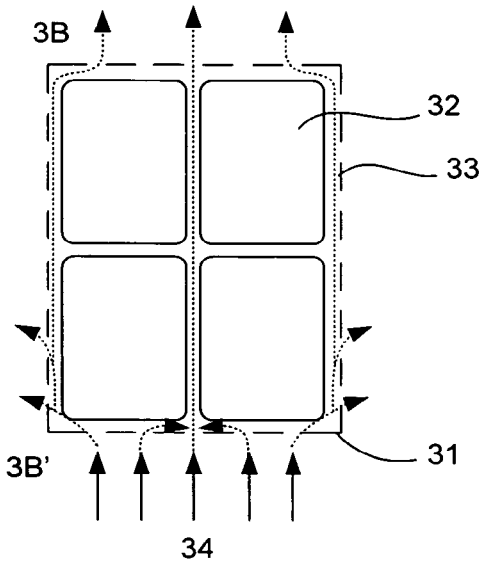

When these containers are used with a typical non-inventive tray certain shortcomings become readily apparent. Cooling efficiencies are low and packing densities are lower. FIGS. 3A and 3B depict some of the problems inherent in prior art packaging schemes. FIG. 3A depicts a tray 31 loaded with containers 32. Tray vents 33 are depicted. If the ventilation features of the containers 32 are not substantially aligned with the cooling vents 33 of the trays 31 a number of undesirable processes occur. For one, cooling air flow commonly takes the path of least resistance. Thus, unless forced into the containers 32, the flowing air 34 sucked in by a cooling system generally flows around the containers and through the tray and out the other side with a minimal cooling interaction with the produce contained within the containers. Additionally, turbulence is generated in the airflow through the container where air movement becomes stagnant in portion of the tray. This stagnant air pools in certain areas of the tray and becomes steadily warmer through exposure to the warm contents of the containers 32. Thus, a pool of warm air remains in the trays preventing the contents of certain portions of the tray and selected produce containers from cooling properly. And additionally, the same properties cause other portions of the tray to become excessively cool. It is not uncommon for some produce on the same layer to become frozen (and therefore unusable) while other produce becomes warm and subject to premature spoilage.

The inventors have conceived of a system and packaging method that enables high packing density and superior cooling performance. Such a system incorporates a specially designed family of produce containers ("clamshells") having particularly positioned and shaped ventilation slots optionally coupled with particularly positioned and shaped ventilation channels. The system further includes packaging trays for holding the containers. The trays being arranged of a particular size and having advantageously shaped and positioned ventilation openings. The one of the features of the system is that the containers and trays are configured so that when the containers are loaded into a tray, the tray vents and container vents (and channels) are in substantial alignment with each other. In some embodiments the vents and openings can be of about the same size as each other. This maximizes cooling effect on the contents of the containers by insuring that the majority of the cooling flow passing into tray openings passes into the containers through the container ventilation slots or through the ventilation channels created.

Figure 4:
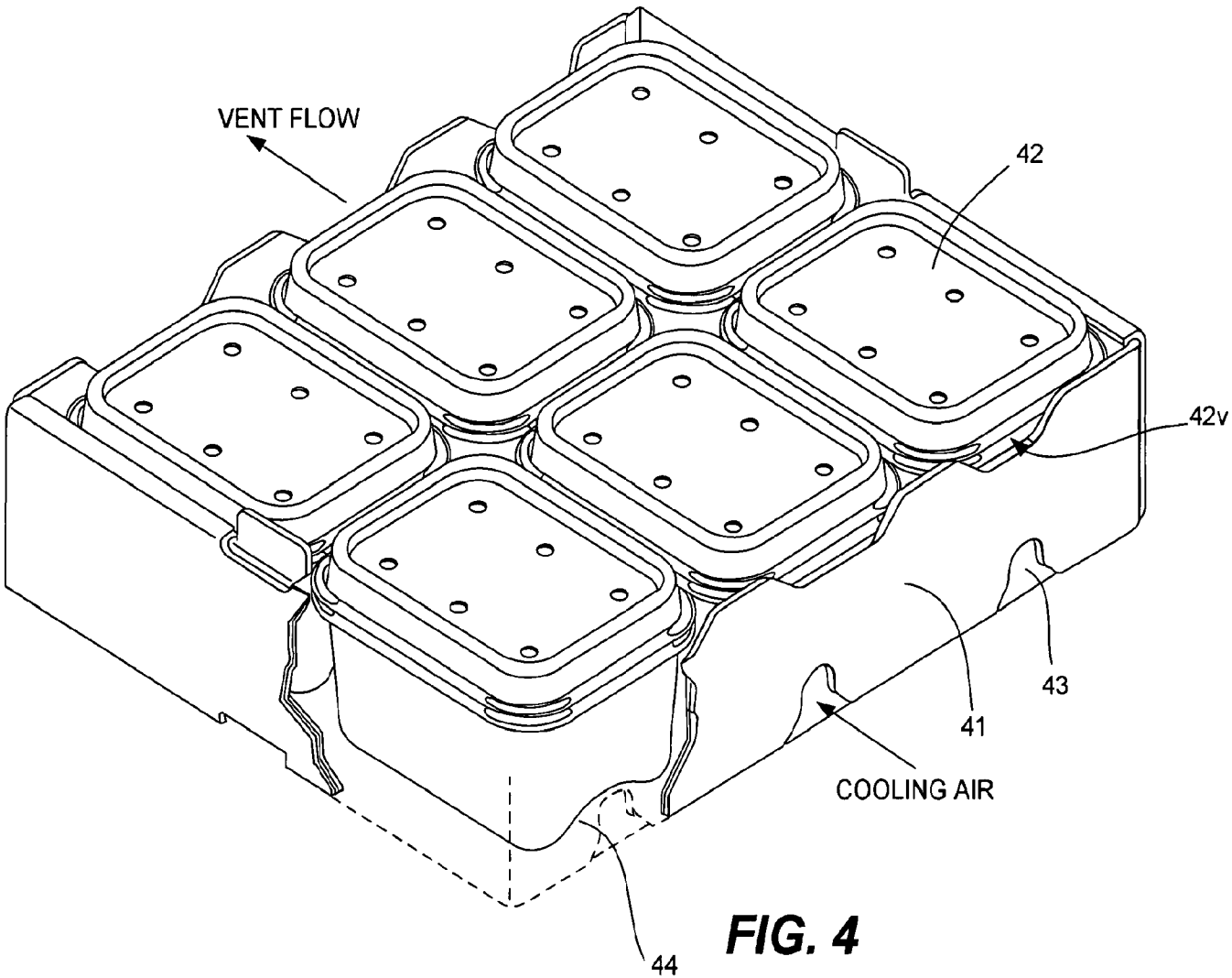
FIG. 4 is a perspective view of a tray embodiment of the present invention loaded with packaging containers in accordance with the principles of the invention.

FIG. 4 depicts a loaded tray 41 filled with six baskets 42 arranged to take advantage of the ventilation slots and openings. The inventors specifically point out that this loading regime is one of many possible loading arrangements contemplated by the inventors. For example, the trays can be configured to accommodate two or more layers of baskets. For example, the loaded tray can be filled with 12 baskets one pound baskets arranged to take advantage of ventilation slots and openings in the trays. Additionally, of the configurations and arrangements may be employed (e.g., the trays may be configured to accommodate four-two (2) pound baskets or two-four (4) pound baskets or in a further example 18-six (6) oz baskets per tray). The inventors further contemplate many other loading configurations.

The depicted baskets 42 can be formed of a number of different materials, however, clear plastic container is preferred. The depicted embodiment is a vacuum formed one piece plastic structure with hinged lid. The inventors point out that the principles of the present invention are equally applicable to alternative materials and manufacturing technologies. In one embodiment of the present invention, the basket is formed of Kodapak® PET Copolyester 9921, available from Eastman Kodak. Alternative materials include, but are not limited to various polymeric and monomeric plastics including but not limited to styrenes, polyethylenes including HDPE and LPDE, polyesters and polyurethanes; metals and foils thereof; paper products including chipboard, pressboard, and flakeboard; wood and combinations of the foregoing. Alternative manufacturing technologies include, but are again not limited to thermocasting; casting, including diecasting; thermosetting; extrusion; sintering; lamination; the use of built-up structures and other processes well known to those of ordinary skill in the art. Commonly, the lid is secured to the basket body using a latch mechanism. Numerous latching mechanisms can be employed to include, but are specifically not limited to, edge catches, button catches, snaps, hook-and-loop closures, and other closure methodologies well-known to those having ordinary skill in the art. Moreover, the term "latch" as used herein may further comprise alternative lid closure methodologies known to those having ordinary skill in the art including shrinkwrap banding the lid to the body, and the use of elastic bands or adhesive tapes to perform this latching function.

With continued reference to FIG. 4 the tray 41 includes lower ventilation openings 43 that are in alignment with the ventilation channels 44 (shown in the cutaway portion of the lower lefts side) to enable a cooling airflow to pass into the tray and under the containers through the successively aligned ventilation channels 44. Additionally, upper ventilation openings 45 are provided to enable air to flow into and through the containers 42. In the depicted embodiment 40, the upper ventilation openings 45 comprise cutouts sized at about the same width as the ventilation slots 42*v* of the containers 42. Alternatively, one single large ventilation opening can be used to provide access to the all of the ventilation slots 42*v* of all containers 42. Additionally, the upper ventilation openings 45 need not comprise cutouts, but rather can be slots cut into the tray. These slots can be sized and spaced to enable airflow into the ventilation slots 42*v* of the containers 42. It can be seen with reference to FIG. 4 that the ventilation slots 42*v* are aligned with each other. The baskets 42 of each row are aligned so that ventilation slots 42*v* of the baskets are adjacent to and aligned with ventilation slots of other baskets in the row. Thereby, the flow of air into the tray proceeds through the ventilation openings into the ventilation slots of each basket in the row through the baskets and out the opposite end ventilation slot where it passes through the ventilation slot of the next basket and so on until it exits the tray by the opposite end ventilation opening. This provides substantially improved cooling.

The inventors point out that while some embodiments make use of lower ventilation openings 43 that are in alignment with the ventilation channels 44 and upper ventilation openings 45 are provided to enable air to flow into and through the containers 42, other embodiments can be employed using trays having only upper ventilation openings or only lower ventilation openings 43 depending on the need, requirements, and desires of the end user.

While the preceding discussion regarding a first preferred embodiment has centered on a one piece basket incorporating the basket body and lid joined by a hinge, it will be immediately apparent to those of ordinary skill in the art that the principles of the present invention may with equal facility be embodied in a two piece implementation utilizing a separate body and lid. This embodiment is specifically contemplated by the teachings of the present invention.

Continued research into produce cooling has shown that some produce type/quantity combinations require different velocities of cooling air to achieve optimal cooling. This can be attained by altering the size of slots 42*v*. For example, in some implementations, the vertical extent of slot 42*v* can be substantially increased upwardly or downwardly from the embodiment shown in FIG. 4. Yet another cooling regime may be implemented in accordance with the teachings of the present invention. For example, the previously discussed cooling channel 44 and its associated tray openings 43 can be eliminated.

The inventors point out that the embodiments can be formed of cut and folded corrugated cardboard formed in a manner well known to those of skill in the art. One such corrugated cardboard is Georgia-Pacific USP120-USP 85-USP120, although any number of packaging materials well known to those of ordinary skill in the art could, with equal facility, be used. Such alternative materials include, but are not limited to various cardboards, pressboards, flakeboards, fiberboards, plastics, metals and metal foils. Alternatively or additionally, tray embodiments using additives, coatings, and/or liners are contemplated by the inventors. For example, wax treated papers, or plastic coated trays can be used and are well within the contemplated inventive aspects of the invention. In some embodiments of a tray, it may further be advantageous to incorporate a gluing, adhesive or fastening step in fabrication of the tray, again in accordance with generally accepted practices in container design and fabrication.

When smaller sized trays are employed with the present invention, a lighter grade of corrugated board can be used for their manufacture than are trays required to support the greater weight and greater area of larger baskets. This lighter weight not only minimizes shipping costs, but can significantly reduce packaging costs for the shipper, again lowering consumer costs. The principles of the present invention may be implemented using alternative tray materials including, but are not limited to various polymeric and monomeric plastics again including but not limited to styrenes, polyethylenes including HDPE and LPDE, polyesters and polyurethanes; metals and foils thereof; paper products including chipboard, pressboard, and flakeboard; wood; wire; and combinations of the foregoing.

Additionally, basket embodiments have been previously discussed that enable bi-directional cooling. Example embodiments are depicted in FIGS. 2A and 2B. As, such they feature ventilation slots on the hinge and face sides of the basket instead of just the sides as shown in FIG. 4.

Figure 5:
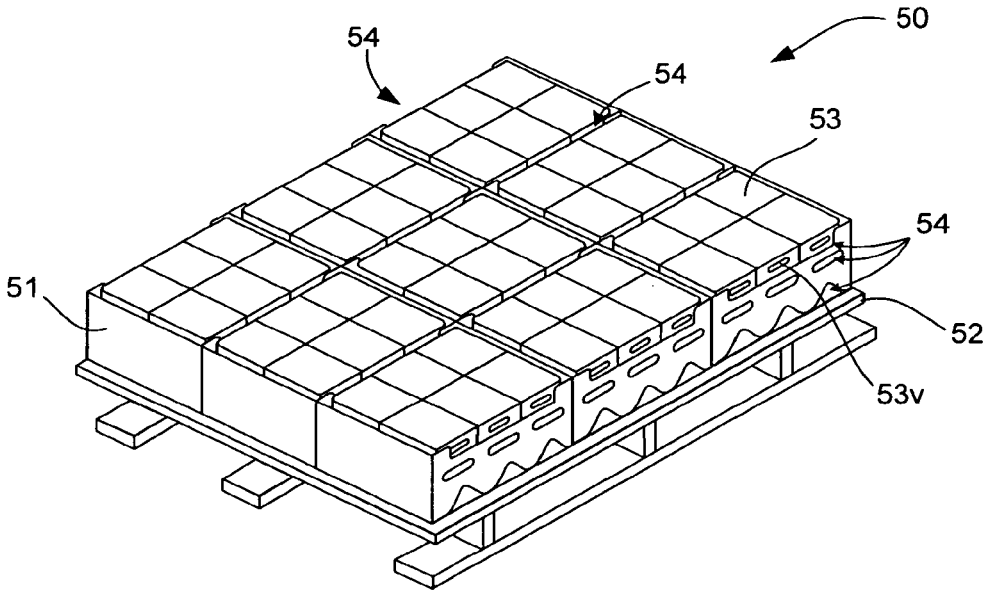
FIG. 5 is a perspective view of a shipping pallet loaded with trays and packaging containers arranged in accordance with the principles of the invention.

Having reference now to FIG. 5, a significant savings in shipping costs can be realized by sizing baskets and trays as a system to maximize the area or shipping footprint of a layer of trays on a pallet. As previously discussed, the standard 40 inch by 48 inch pallet is the preferred size in the grocery business in the United States. Existing systems are capable of loading a maximum of six trays on a layer of a 40 inch by 48 inch pallet. Where the trays are loaded with eight (8) one pound strawberry baskets, a maximum of 48 pounds of fruit may thus be loaded in each layer.

In contrast, in one embodiment of the present invention the baskets are configured to receive one pound of strawberries and are sized at approximately 6⅜"×5"×3¾ high, when closed. The associated tray of the present invention is sized at approximately 16"×13¼". This size enhances the volume of fruit containable for the footprint of a standard pallet. Moreover, this means that nine such trays can be loaded as a layer on the previously described pallet, for a total of 54 pounds of fruit per layer. This translates into 972 lbs per pallet versus 864 lbs per pallet for the prior art packing methods. This translates into a 12.5 percent increase in fruit volume per pallet. Since fees are charged on a per pallet basis, the merchant is not paying for wasted shipping volume and his shipping costs are thereby reduced, which can result in further savings to the consumer.

In another embodiment, the one pound of strawberries are arranged in an associated tray of the present invention that is sized and configured to accommodate two layers of baskets for each tray. Thus, each tray contains twelve (12) baskets. This size maximizes the footprint on a standard pallet. Again, nine such trays can be loaded as a layer on the previously described pallet. This can facilitate a loading of 1080 baskets per pallet and still maintain a 75" height limit. This translates into a 25 percent increase in fruit volume per pallet. Since fees are charged on a per pallet basis, the merchant is not paying for wasted shipping volume and his shipping costs are thereby reduced, which can result in further savings to the consumer. In one representative example, the freight saved for California strawberry production alone (about 135 million trays of strawberries) could be as high as $65 million, including gas consumption.

With continuing reference to FIG. 5, the inventors point out that the depicted embodiment demonstrates some surprising cooling properties to be discussed in detail in the following paragraphs. First the trays 51 are loaded with baskets 53 which are arranged in the tray so that ventilation slots 53*v* and/or channels of the baskets are aligned with tray ventilation openings 54. Nine (9) trays 51 are loaded onto a standard pallet 52. The trays 51 are arranged so that the ventilation openings 54 are in alignment with ventilation openings 54 of other trays of the same layer. This 3 by 3 layer of trays comprises a so-called "nine-down" configuration. This configuration has some surprising cooling advantageous over five-down and "six-down" packaging configurations.

The inventors point out that good temperature management involves rapid cooling and maintenance of low fruit temperature. In fact, this has been shown to be the single most important factor in fruit deterioration. This is especially the case for delicate fruit like strawberries, etc. Quick cooling and keeping the pulp temperature low maximize the postharvest life of the fruit.

It is important to cool the fruit as soon as possible after harvesting in order to maintain a maximum post harvest life. Removing the post harvest "field heat" as quickly as possible has proven to be a difficult yet critically important factor in fruit longevity. Additionally, quick cooling reduces produce moisture loss, inhibits the growth and spread of microorganisms, and increases the fruits robustness when subject to bruising and other injuries.

As is known to those having ordinary skill in the art many factors impact berry cooling rate. And it has been determined that keeping berry temperatures near 34° F. (1° C.) is an important factor in berry longevity. An increase of temperature of 10° C. (i.e., from 34° F. to 50° F.) results in a rate of deterioration that is 2-4 times greater than that of berries kept at 34° F. For every hour that a berry is exposed to room temperature, the shelf life is reduced by one day. Accordingly, berries maintained at the higher temperature (10° C.) have a life expectancy of one quarter of cooler berries. However, by quickly cooling the berries using pre-cooling and proper storage the shelf life of strawberries can be extended beyond one week.

Extensive testing of the inventive "nine-down" system as compared to competitive five-down and six down systems has revealed some surprising cooling advantages.

Figure 6:
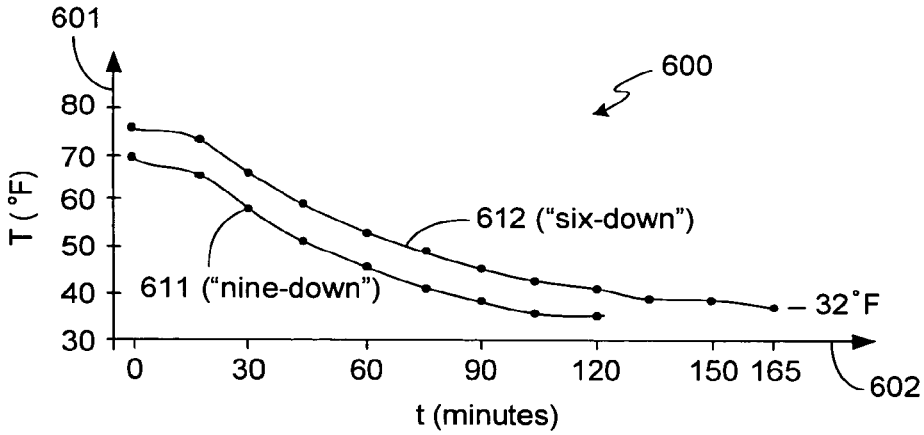
FIG. 6 is a graph depicting the cooling behavior of various cooling systems illustrating the unexpected advantage of a "nine-down" embodiment configured in accordance with the principles of the invention.

FIG. 6 is a graphic depiction of cooling profiles comparing pallets loaded in a "six-down" configuration with pallets loaded in a "nine-down" vented configuration in accordance with the principles of the invention. In the graph 600, line 601 refers to temperature (in degrees Fahrenheit) and line 602 refers to cooling time in minutes. Line 611 refers to the cooling profile for the inventive "nine-down" configuration (e.g., as shown in FIG. 5) and line 612 refers to a "six-down" configuration. The berries were picked at the same time in the field. It is noted that during transport from the field the "nine-down" system demonstrates a superior cooling property. First, by the time the berries reach the cooler the "nine-down" berries are already 4° F. cooler than the "six-down". Thus, at time=0, the "nine-down" packaging configuration is already substantially cooler due to superior cooling properties. During cooling in a 34° F. cooler the "nine-down" configuration 611 demonstrates a surprising cooling advantage enabling an entire pallet of berries to cool down to 34° F. in about two hours. In contrast the "six-down" system can require about 165 minutes to cool to the necessary temperature. This extra cooling time translates into 1 day(s) less shelf life. Moreover, this increased cooling rate applies to a greater volume of fruit because the pallets will contain more fruit. When coupled with the increase susceptibility to damage, increased susceptibility to microbes, and reduced shelf life the inventive system saves about $60.00 per pallet in costs to the merchant and consumer. When extrapolated across the entire strawberry industry, this can translate in to a savings of $75 million dollars a year.

The aforementioned advantages are further magnified by the increased packaging densities possible with the inventive "nine-down" system. As described above, the standard pallet is confined to 864 pounds of fruit per pallet versus 1080 pounds (or 972 lbs. depending on configuration) per pallet for the inventive system. This of can add a further 25% to the value of each pallet, which can result in a further $216.00 in increased economic value per pallet. Moreover, when coupled with the advantages of the smooth wall baskets (which lead to less bruising and loss of fruit) a further 7% reduction in fruit damage losses is enjoyed. Thus, the system and its unique packing arrangement enables a substantial and unexpected increase in the amount of salable fruit provided to the end user. This results in a substantial savings to the merchant and end user.

Figure 7A:
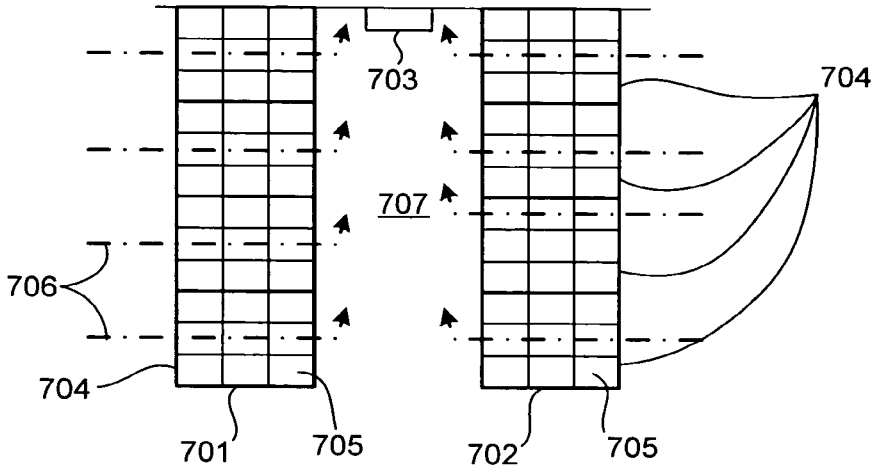
FIGS. 7A & 7B are simplified plan and perspective views (respectively) illustrating air flow processes in accordance with the principles of the invention.
Figure 7B:
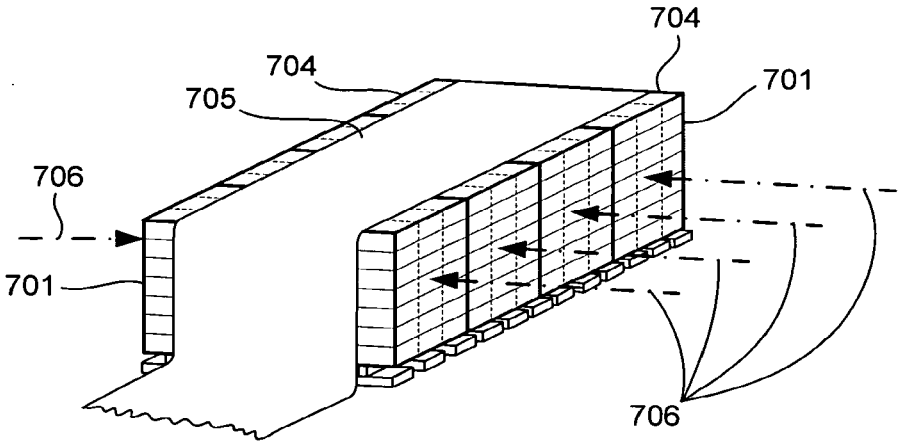

Once the trays are loaded onto a pallet in a "nine-down" layer. Several identically orient 3 by 3 layers of trays are stacked on top to fill out each pallet. These pallets are then loaded into a cooler and refrigerated to the desired temperature (usually near 32° F.) where they remain till shipped. FIG. 7A is a top down view of rows 701, 702 of pallets 704 straddling a forced air unit 703. The forced air unit 703 can be used to suck cold air (the dotted dashes arrows 706) from the cooling chamber through the trays 705 and baskets of each pallet 704 and into the open space 707 between the rows. FIG. 7B provides a perspective view of the pallet rows 701, 702 in the cooling process. A cover 708 is laid over the open space 707 between the rows to enable the cool air from the cooling chamber to be sucked through the ventilation openings in the trays 704 where it passes through and/or under the baskets within the trays to effectuate cooling.

The preceding discussion of an embodiment of the present invention has focused on one specific berry package design. It will be immediately obvious to those of ordinary skill in the art that the principles set forth herein are also applicable to a wide range of produce package sizes and utilizations. By way of illustration but not limitation, the present invention specifically contemplates the forming of 1 pint (also sometimes referred to as 8.8 oz., 8 oz., or 250 g.) and ½ pint (also sometimes referred to as 6 oz. or 125 g.) berry baskets, as well as a vast array of different sized baskets configured to receive therein specific produce shapes, types and counts. An example of the latter is the "long stem pack" used in the berry industry for shipping specific package counts of large, premium berries. Furthermore, while the discussion of the principles set forth herein has centered on packages for the berry industry, it is recognized that these principles may be applied with equal facility to the packaging of a broad range of materials including other foodstuffs or any item which would benefit from the advantages set forth herein. Such applications are specifically contemplated. These principles include the use of a family of trays, having fixed "footprints" or lengths and widths, but with whose heights are varied to accommodate baskets having different heights and/or counts per tray. By maintaining the footprint at a constant value, the advantages of minimizing lateral movement between individual trays and between layers of trays are attained because the trays of one layer interlock with the layer of trays above or below it. This is true even where adjacent tray layers contain significantly differing sizes of baskets, holding the same or different produce items.

Where the tray is designed to receive one pound strawberry baskets as previously discussed, the height of the tray is approximately 3¾ inches. Where other berries, or indeed other produce products are shipped, the length and width of the tray do not change, but remain at the previously defined optimal size. Changes in tray volume necessary to accommodate differing numbers and volumes of baskets are accommodated by altering the height of the tray. In similar fashion, baskets designed for use in the present system are sized to fit within the previously discussed tray. In this manner, baskets suitable for substantially any size basket designed for consumer use, as well as many baskets sized for the food service industry, may be accommodated by the present invention. This presents the previously described advantage of enabling the shipment of a mixed pallet of differing produce by loading trays optimized for each type of produce onto separate, compatible layers.

Figure 8:
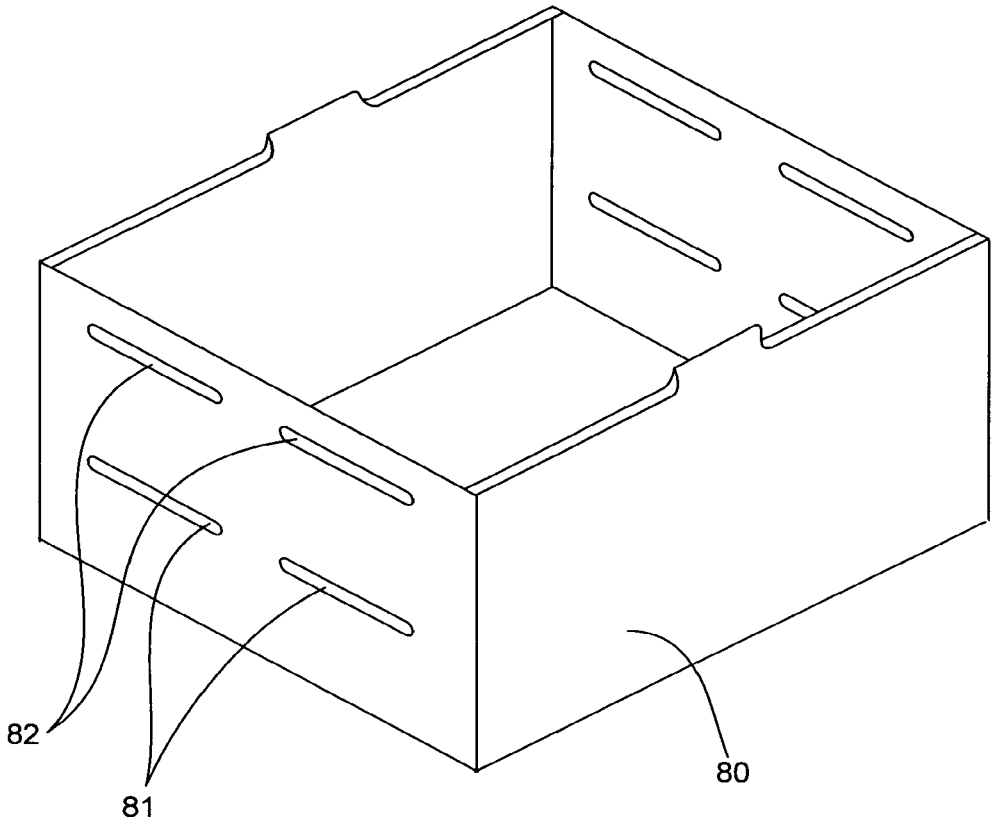
FIG. 8 is a perspective view of a tray embodiment constructed in accordance with the principles of the invention.

FIG. 8 provides a perspective view of a multi-layer tray embodiment 80. The tray 80 is configured so that a first layer of containers can be placed in the tray. A first set of ventilation openings 81 are arranged to align with the ventilation slots of a first layer of baskets positioned in the tray. A second set of ventilation openings 82 are arranged to align with the ventilation slots of a second layer of baskets positioned in the tray on top of the first layer of baskets. As with the other embodiments of the invention, the inventors contemplate that the width of the ventilation openings can be of about the same width as the ventilation slots of the containers. Additionally, another set of ventilation openings can be made near the bottom of the tray to enable a cooling airflow to pass through a cooling channel of the baskets if such a basket embodiment is employed. Also, the first set of ventilation openings 81 can be expanded (for example, widened in a vertical direction) to additionally align with the lower ventilation channels of the second layer of baskets that are positioned on top of the first layer of baskets. Alternatively, a third set of ventilation openings could be positioned between openings 81, 82 to align with the lower ventilation channels of the second layer of baskets to enable airflow through the tray.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the use of alternative basket forming technologies, tray forming technologies, basket and tray materials and specifications, basket shapes and sizes to conform to differing produce requirements, and vent configurations are all contemplated by the principles of the present invention.

The present invention has been particularly shown and described with respect to certain preferred embodiments and specific features thereof. However, it should be noted that the above-described embodiments are intended to describe the principles of the invention, not limit its scope. Therefore, as is readily apparent to those of ordinary skill in the art, various changes and modifications in form and detail may be made without departing from the spirit and scope of the invention as set forth in the appended claims. Other embodiments and variations to the depicted embodiments will be apparent to those skilled in the art and may be made without departing from the spirit and scope of the invention as defined in the following claims. Although only a few specific configurations are expressly disclosed herein, it should be appreciated by anyone having ordinary skill in the art that, using the teachings disclosed herein, many different packaging configurations can be implemented and still fall within the scope of the claims. Further, reference in the claims to an element in the singular is not intended to mean "one and only one" unless explicitly stated, but rather, "one or more". Furthermore, the embodiments illustratively disclosed herein can be practiced without any element which is not specifically disclosed herein.

We claim:

1. A produce packaging system configured to enhance cooling, the arrangement comprising:

a plurality of produce packaging containers, each container having a lid and a body, the lid and body configured so that when the lid is closed it defines at least a first and a second horizontal ventilation slot respectively on opposing ends of the basket, each slot disposed between the lid and body, and a lower surface of the body defining a ventilation channel configured to enable a ventilating flow to pass underneath the container; and a plurality of trays for receiving said plurality of said baskets, the tray including at least two rows of tray ventilation features comprising at least a first row of ventilation features arranged above a second row of ventilation features;

the plurality of produce packaging containers arranged in each tray in two layers, the horizontal ventilation slots of the second row containers being arranged in registry with the second row of ventilation features of the tray, thereby facilitating the flow of air through the containers of the second row of containers, and the horizontal ventilation slots of the first row containers being arranged in registry with the first row of ventilation features of the tray, thereby facilitating the flow of air through the containers of the second row of containers.

2. The produce packaging system of claim 1 wherein the bottom of the body is arched thereby providing said ventilation channel under each container when it is positioned in the tray, the ventilation features of the tray further comprising rows of channel ventilation openings arranged in registry with the ventilation channels thereby facilitating a cooling flow in through one such opening in a first side of the tray, under said container, and out of another opening arranged in an opposite second side of the tray.

3. The produce packaging system of claim 1 wherein the plurality of said trays are arranged on a pallet in a three by three layer of nine trays disposed on the pallet so that ventilation features of the cooling trays are in alignment with ventilation features of at least one other cooling tray of the layer.

4. The produce packaging system of claim 3 wherein the layer of nine trays covers a forty by forty-eight in shipping pallet.

5. The produce packaging system of claim 3 wherein the ventilation features have a feature width of about the same width as the ventilation slots of the containers.

6. The produce packaging system of claim 1 wherein the plurality of produce packaging containers are arranged in the plurality of trays so that ventilation slots of the containers are in alignment with the ventilation slots of other containers and with the ventilation features of the trays thereby enabling airflow to pass into the tray through the ventilation features and through each of the containers by passing through the aligned ventilation slots of adjacent containers and out of the tray through a ventilation opening at an opposite end of the tray.

7. The produce packaging system of claim 6 wherein the bottoms of each container body is arched thereby providing said ventilation channel under each container when it is positioned in the tray, the ventilation features of the tray further comprising rows of channel ventilation openings arranged in registry with the ventilation channels thereby facilitating a cooling flow in through one such opening in a first side of the tray, under an associated container, and out of another opening arranged in an opposite second side of the tray.

8. The produce packaging system of claim 1 wherein at least some of the horizontal ventilation slots of the first and second rows containers are located adjacent to respective first and second ventilation features of the tray.

9. A produce packaging system configured to enhance cooling, the arrangement comprising:

a basket comprising a basket body and a lid, the lid and body configured so that when the lid is closed it defines at least two horizontal ventilation slots on opposing ends of the basket, each slot disposed between the lid and body, and a lower surface of the basket body defining a ventilation channel; and a tray for receiving a plurality of said baskets, the tray including a first set of ventilation openings formed in the tray in alignment with the ventilation channel when a basket is loaded into the tray to facilitate through at least one ventilation channel and out of the tray through another first ventilation opening on an opposite end of the tray the flow of air, and a second set of ventilation openings formed in the tray in alignment with the basket ventilation slot when a basket is loaded into the tray to facilitate the flow of air into the tray through one first ventilation opening into the basket through the basket ventilation slot enabling the flow to pass through and exit the basket through another ventilation slot at an opposite end of the basket, wherein the plurality of said trays are arranged on a pallet in a three by three layer of nine trays disposed on the pallet so that ventilation openings of the cooling trays are in alignment with ventilation openings of at least one other cooling tray of the layer, and wherein the second set of ventilation openings of the tray has a width of about the same width as the basket ventilation slot.

* * * * *